US006074274A

United States Patent [19]

Pyatt et al.

[11] Patent Number: 6,074,274

[45] Date of Patent: Jun. 13, 2000

[54] UNDERGARMENT

[76] Inventors: M. Jerri Pyatt, 1019 N. Huntingtower, Montgomery, Tex. 77356; Robin Gnemi, 16206 LaFone Dr., Spring, Tex. 77379

[21] Appl. No.: 09/156,095

[22] Filed: Sep. 17, 1998

[51] Int. Cl.[7] ..... A41D 1/00

[52] U.S. Cl. ..... 450/101; 450/95; 2/228; 2/238

[58] Field of Search ..... 2/228, 238; 450/95, 450/100, 101, 104, 112, 115, 116, 156

[56] References Cited

U.S. PATENT DOCUMENTS

| | | | |
|---|---|---|---|
| D. 360,516 | 7/1995 | Persinger | 2/228 X |
| 3,175,560 | 3/1965 | Menzies | 2/112 |
| 3,380,455 | 4/1968 | Glogover | 2/112 |
| 3,421,516 | 1/1969 | Erteszek | 2/112 |
| 3,465,757 | 9/1969 | Barg | 2/112 |
| 4,961,233 | 10/1990 | Black | 2/228 |
| 5,136,727 | 8/1992 | Brisco | 2/228 X |

*Primary Examiner*—Gloria M. Hale

[57] ABSTRACT

A new undergarment for eliminating panty lines and panty bulges while wearing shorts or skirts. The inventive device includes a torso portion that has a front, a back, a top, a bottom, an interior, and an upper waist opening into the interior of the torso portion. A resiliently elastic waist band extending around a periphery of the upper waist opening. A pair of leg portions extend from the bottom of the torso portion. Each of the leg portions has a root portion and a lower end. The root portions of the leg portions are coupled to the bottom of the torso portion. The lower end of each of the leg portions has a lower opening through which a leg may be extended.

19 Claims, 3 Drawing Sheets

UNDERGARMENT

BACKGROUND OF THE INVENTION

1. Field of the Invention

The present invention relates to undergarments and more particularly pertains to a new undergarment for eliminating panty lines and panty bulges while wearing shorts or skirts.

2. Description of the Prior Art

The use of undergarments is known in the prior art. More specifically, undergarments heretofore devised and utilized are known to consist basically of familiar, expected and obvious structural configurations, notwithstanding the myriad of designs encompassed by the crowded prior art which have been developed for the fulfillment of countless objectives and requirements.

Known prior art undergarments include U.S. Pat. No. 3,678,515; U.S. Pat. No. 4,009,495; U.S. Pat. No. 3,909,851; U.S. Pat. No. 5,136,727; U.S. Pat. No. 4,624,115; and U.S. Pat. No. Des. 313,692.

While these devices fulfill their respective, particular objectives and requirements, the aforementioned patents do not disclose a new undergarment. The inventive device includes a torso portion that has a front, a back, a top, a bottom, an interior, and an upper waist opening into the interior of the torso portion. A resiliently elastic waist band extending around a periphery of the upper waist opening. A pair of leg portions extend from the bottom of the torso portion. Each of the leg portions has a root portion and a lower end. The root portions of the leg portions are coupled to the bottom of the torso portion. The lower end of each of the leg portions has a lower opening through which a leg may be extended.

In these respects, the undergarment according to the present invention substantially departs from the conventional concepts and designs of the prior art, and in so doing provides an apparatus primarily developed for the purpose of eliminating panty lines and panty bulges while wearing shorts or skirts.

SUMMARY OF THE INVENTION

In view of the foregoing disadvantages inherent in the known types of undergarments now present in the prior art, the present invention provides a new undergarment construction wherein the same can be utilized for eliminating panty lines and panty bulges while wearing shorts or skirts.

The general purpose of the present invention, which will be described subsequently in greater detail, is to provide a new undergarment apparatus and method which has many of the advantages of the undergarments mentioned heretofore and many novel features that result in a new undergarment which is not anticipated, rendered obvious, suggested, or even implied by any of the prior art undergarments, either alone or in any combination thereof.

To attain this, the present invention generally comprises a torso portion that has a front, a back, a top, a bottom, an interior, and an upper waist opening into the interior of the torso portion. A resiliently elastic waist band extending around a periphery of the upper waist opening. A pair of leg portions extend from the bottom of the torso portion. Each of the leg portions has a root portion and a lower end. The root portions of the leg portions are coupled to the bottom of the torso portion. The lower end of each of the leg portions has a lower opening through which a leg may be extended.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new undergarment apparatus and method which has many of the advantages of the undergarments mentioned heretofore and many novel features that result in a new undergarment which is not anticipated, rendered obvious, suggested, or even implied by any of the prior art undergarments, either alone or in any combination thereof.

It is another object of the present invention to provide a new undergarment which may be easily and efficiently manufactured and marketed.

It is a further object of the present invention to provide a new undergarment which is of a durable and reliable construction.

An even further object of the present invention is to provide a new undergarment which is susceptible of a low cost of manufacture with regard to both materials and labor, and which accordingly is then susceptible of low prices of sale to the consuming public, thereby making such undergarment economically available to the buying public.

Still yet another object of the present invention is to provide a new undergarment which provides in the apparatuses and methods of the prior art some of the advantages thereof, while simultaneously overcoming some of the disadvantages normally associated therewith.

Still another object of the present invention is to provide a new undergarment for eliminating panty lines and panty bulges while wearing shorts or skirts.

Yet another object of the present invention is to provide a new undergarment which includes a torso portion that has a front, a back, a top, a bottom, an interior, and an upper waist opening into the interior of the torso portion. A resiliently elastic waist band extending around a periphery of the upper waist opening. A pair of leg portions extend from the bottom of the torso portion. Each of the leg portions has a root portion and a lower end. The root portions of the leg portions are coupled to the bottom of the torso portion. The lower end of each of the leg portions has a lower opening through which a leg may be extended.

Still yet another object of the present invention is to provide a new undergarment that may be worn with shorts or skirts in place of panties to eliminate panty lines.

Even still another object of the present invention is to provide a new undergarment that provides more ventilation than panties, thereby reducing the build up of heat in the skin of the torso and crotch of a wearer.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
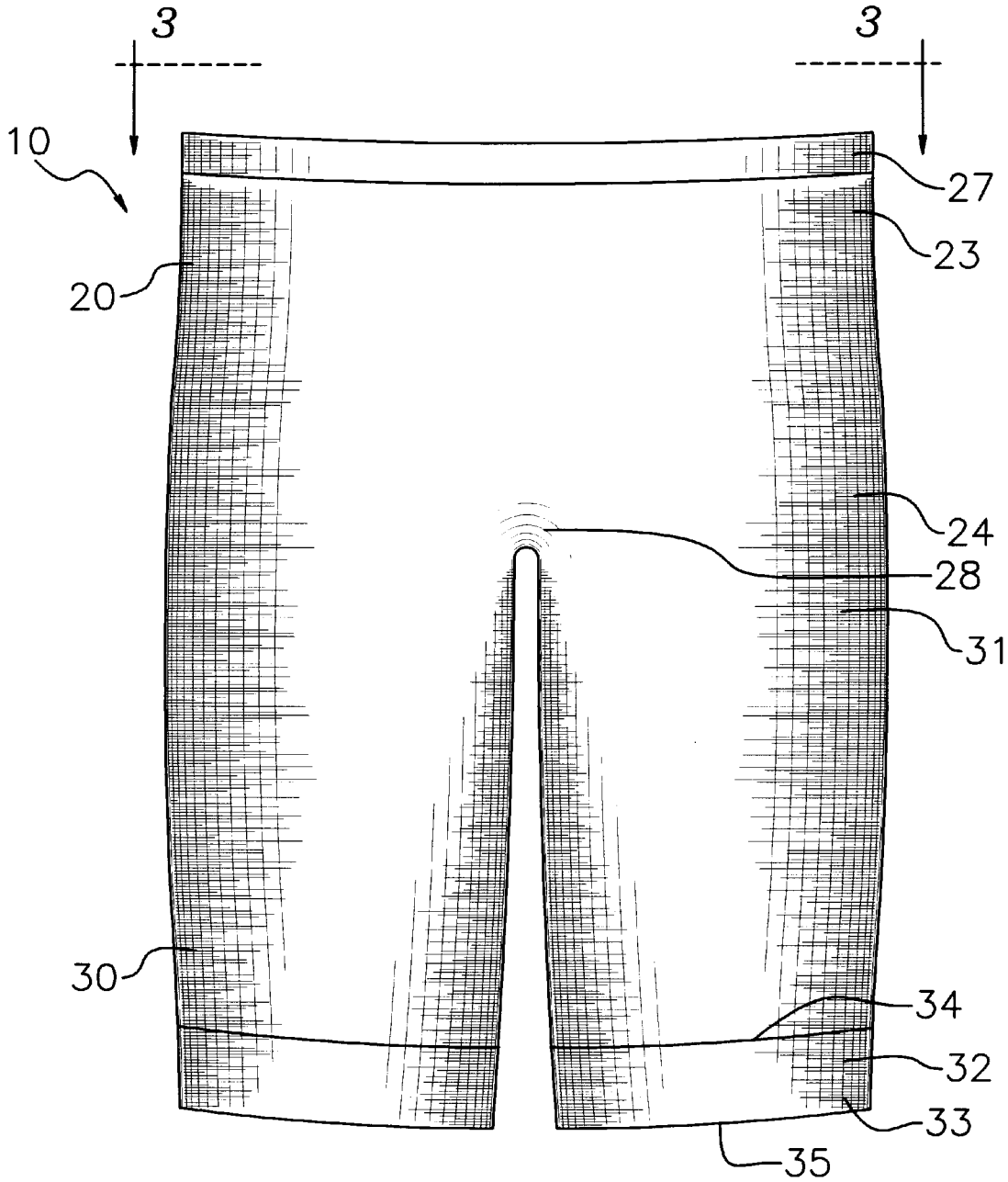
FIG. 1 is a side view of a new undergarment according to the present invention.
Figure 2:
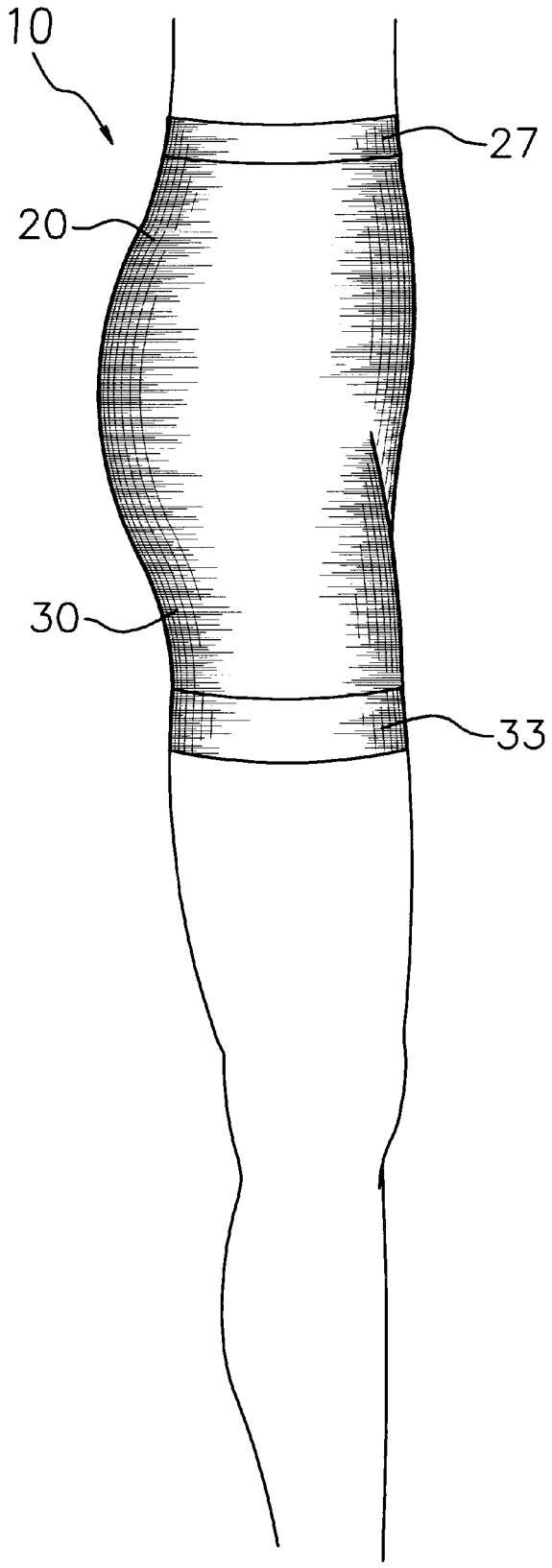
FIG. 2 is a side view of the present invention.
Figure 3:
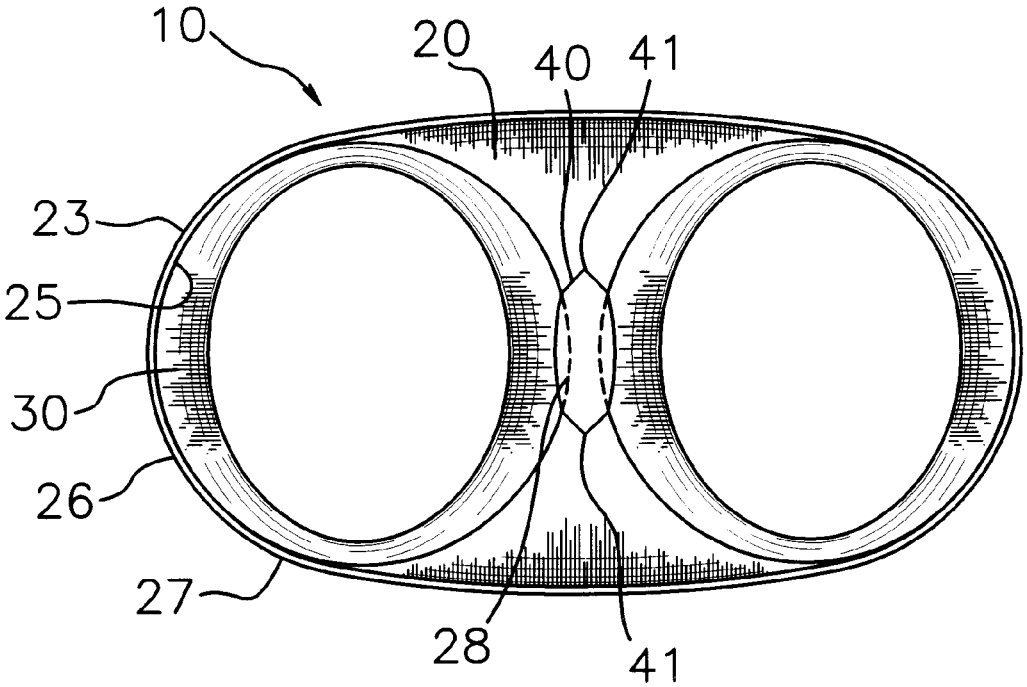
FIG. 3 is a top view of the present invention taken from line 3—3 of FIG. 1.
Figure 4:
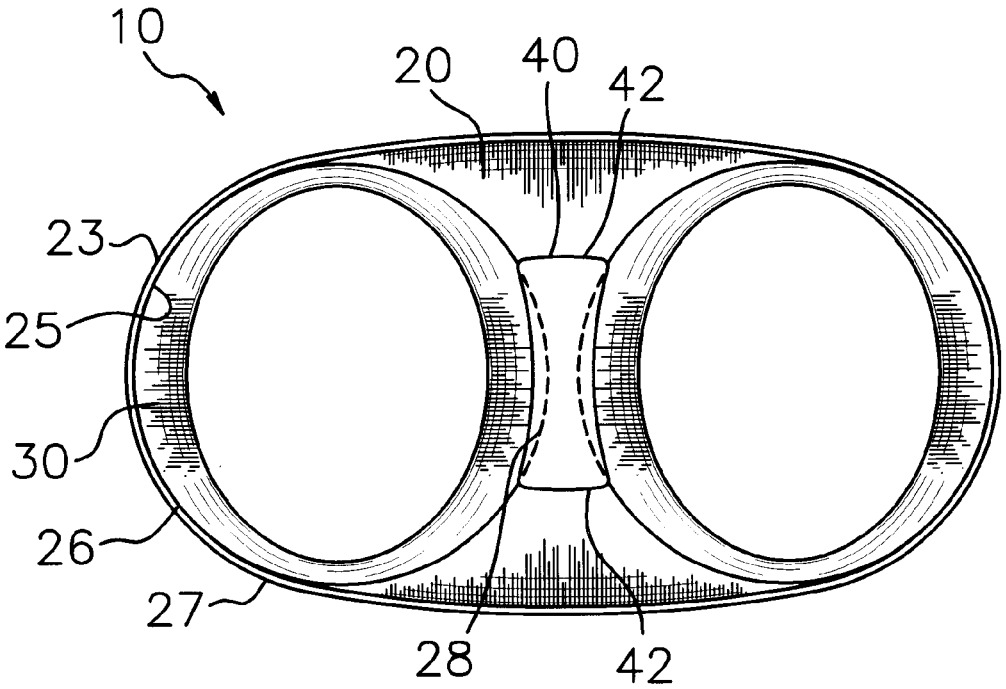
FIG. 4 is a top view of the present invention with an alternate cotton layer in the crotch region.

With reference now to the drawings, and in particular to FIGS. 1 through 4 thereof, a new undergarment embodying the principles and concepts of the present invention and generally designated by the reference numeral 10 will be described.

As best illustrated in FIGS. 1 through 4, the undergarment 10 comprises a torso portion 20 that has a front 21, a back 22, a top 23, a bottom 24, an interior, and an upper waist opening 25 into the interior of the torso portion 20. A resiliently elastic waist band 27 extends around a periphery 26 of the upper waist opening 25. A pair of leg portions 30 extend from the bottom 24 of the torso portion 20. Each of the leg portions 30 has a root portion 31 and a lower end 32. The root portions 31 of the leg portions 30 are coupled to the bottom 24 of the torso portion 20. The lower end 32 of each of the leg portions 30 has a lower opening for extending a leg therethrough.

Preferably, the torso portion 20 and leg portions 30 comprise elastic nylon to permit greater ventilation of air to skin than that provided by panties. More preferably, the nylon has a silky texture to provide greater comfort to a wearer. Also preferably, the waist band 27 of the torso portion 20 comprises spandex, such as the type marketed under the trademark Lycra.

Preferably, each of the leg bands 33 of the leg portions 30 comprises bicomponent nylon. For example, the bicomponent nylon comprises a mixture of spandex and nylon or elastic rubber and nylon to provide less elasticity than spandex or elastic rubber alone. Ideally, the elasticity of the leg bands 33 around the lower openings of the leg portions 30 is less than about one half the elasticity of the waist band 27 around the periphery 26 of the upper waist opening 25 of the torso portion 20. Most ideally, the elasticity of the leg bands 33 is just enough to hold the leg portions 30 to the legs of the wearer.

Also preferably, a plurality of rubber ridges (not shown) extend from inner surfaces of the leg portions 30. The ridges (not shown) prevent the lower ends 32 of the leg portions 30 from sliding up the legs of a wearer. The rubber ridges (not shown) are positioned towards the lower ends 32 of the leg portions 30. Ideally, the ridges (not shown) are positioned adjacent the leg bands 33 of the leg portions 30 and cover an area that is coextensive with the leg bands 33 of the leg portions 30. Alternately, a plurality of rubber nubs (not shown) may be provided on the inner surfaces of the leg portions 30. In such an embodiment, the nubs (not shown) are positioned on portions of the leg portions 30 towards the lower ends 32 of the leg portions 30. Ideally, the nubs (not shown) are positioned on portions of the leg portions 30 adjacent the leg bands 33 of the leg portions 30 and cover an area that is coextensive with the leg bands 33 of the leg portions 30.

Preferably, the torso portion 20 has a crotch region 28 that extends between the front 21 and back 22 of the torso portion 20 and is positioned between the leg portions 30. The crotch region 28 has a cotton layer 40 on its inner surface. The cotton layer 40 provides a similar function as panties such that the undergarment 10 may be worn instead of panties, thereby eliminating the need to wear panties and the consequential panty lines.

More preferably, the cotton layer 40 of the crotch region 28 is generally diamond shaped. Ideally, the cotton layer 40 of the crotch region 28 has a pair of points 41. One of the points 41 is positioned towards the front 21 of the torso portion 20. Another of the points 41 is positioned towards the back 22 of the torso portion 20. A length of the cotton layer 40 between the points 41 is less than about six inches. Most ideally, the length of the cotton layer 40 of the crotch region 28 between the points 41 is about four inches.

In an alternate embodiment, the cotton layer 40 is generally rectangular shaped. In such an embodiment, the cotton layer 40 has a pair of ends 42. One of the ends 42 is positioned towards the front 21 of the torso portion 20. Another of the ends 42 is positioned towards the back 22 of the torso portion 20. A length of the cotton layer 40 between the ends 42 is less than about eight inches.

In a second alternate embodiment, the cotton layer 40 is hourglass shaped. In such an embodiment, the cotton layer 40 has a pair of ends (not shown). One of the ends is positioned towards the front 21 of the torso portion 20. Another of the ends is positioned towards the back 22 of the torso portion 20. A length of the cotton layer 40 between the ends is less than about eight inches.

Preferably, a length of each of the leg portions 30 is defined between the root portion 31 and the lower ends 32 of each of the leg portions 30. The length of each of the leg portions 30 is greater than about two inches. Ideally, the length of each of the leg portions 30 is between about three and seven inches. For example, the length of each of the leg portions 30 is about four inches for use with short skirts or shorts. For another example, the length of each of the leg portions 30 is about six inches for use with longer shorts and skirts.

Also preferably, each of the leg bands 33 of the leg portions 30 has a primary edge 34 and a secondary edge 35. A width of each of the leg bands 33 is defined between the primary and secondary edges 34,35 of each of the leg bands 33. The width of each of the leg bands 33 is between about one fifth and one tenth the length of each of the leg portions 30.

In use, the wearer puts of the undergarment 10 instead of panties, thereby eliminating panty lines. The cotton layer 40 serves the same purpose as a crotch region of panties. The nylon material from which the torso portion 20 is made permits greater ventilation of air to the skin than that provided by panties. The waist band 27 helps keep the top 23 of the torso portion 20 from slipping down the torso of the wearer. The leg bands 33 and ridges (not shown) help keep the leg portions 30 from slipping up the legs of the wearer.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An undergarment for eliminating panty lines while wearing shorts or skirts, said undergarment comprising:

a torso portion having a front, a back, a top, a bottom, and an upper waist opening;

said upper waist opening of said torso portion having a periphery;

a resiliently elastic waist band extending around said periphery of said upper waist opening;

a pair of leg portions extending from said bottom of said torso portion, each of said leg portions having a root portion and a lower end, said root portions of said leg portions being coupled to said bottom of said torso portion;

said lower end of each of said leg portions having a lower opening and a leg band; and wherein the elasticity of said leg bands around said lower openings of said leg portions is less than about one half the elasticity of said waist band around said periphery of said upper waist opening of said torso portion.

2. The undergarment of claim 1, wherein said torso portion and said leg portions comprise elastic nylon.

3. The undergarment of claim 1, wherein said waist band comprises spandex.

4. The undergarment of claim 1, wherein each of said leg bands comprises bicomponent nylon.

5. The undergarment of claim 1, further comprising a plurality of rubber ridges extending from inner surfaces of said leg portions, said ridges being positioned towards said lower ends of said leg portions, said ridges being for preventing said lower ends of the leg portions from sliding up a leg of a wearer.

6. The undergarment of claim 1, wherein said torso portion has a crotch region extending between said front and back of said torso portion, said crotch region being positioned between said leg portions, said crotch region having a cotton layer.

7. The undergarment of claim 6, wherein said cotton layer of said crotch region is generally diamond shaped.

8. The undergarment of claim 7, wherein said cotton layer of said crotch region has a pair of points, one of said points being positioned towards said front of said torso portion, another of said points being positioned towards said back of said torso portion, wherein a length of said cotton layer between said points is less than about six inches.

9. The undergarment of claim 8, wherein said length of said cotton layer of said crotch region between said points is about four inches.

10. The undergarment of claim 6, wherein said cotton layer of said crotch region is generally rectangular shaped, said cotton layer having a pair of ends, one of the ends being positioned towards the front of the torso portion, another of the ends being positioned towards the back of the torso portion, wherein a length of said cotton layer between said ends is less than about eight inches.

11. The undergarment of claim 1, wherein a length of each of said leg portions is defined between said root portion and said lower ends of each of said leg portions, said length of each of said leg portions being greater than about two inches.

12. The undergarment of claim 11, wherein said length of each of said leg portions is between about three and seven inches.

13. The undergarment of claim 1, wherein each of said leg bands of the leg portions has a primary edge and a secondary edge, wherein a width of each of said leg bands is defined between said primary edge of said leg band and said secondary edge of said leg band, said width of each of said leg bands being between about one fifth and one tenth said length of each of said leg portions.

14. An undergarment for eliminating panty lines while wearing shorts or skirts, said undergarment comprising:

a torso portion having a front, a back, a top, a bottom and an upper waist opening;

said torso portion and said leg portions comprising elastic nylon;

said upper waist opening of said torso portion having a periphery;

a resiliently elastic waist band extending around said periphery of said upper waist opening, said waist band comprising spandex;

a pair of leg portions extending from said bottom of said torso portion, each of said leg portions having a root portion and a lower end, said root portions of said leg portions being coupled to said bottom of said torso portion;

said lower end of each of said leg portions having a lower opening;

each of said lower ends of said leg portions having a resiliently elastic leg band extending therearound, each of said leg bands comprising bicomponent nylon;

a plurality of rubber ridges extending from inner surfaces of said leg portions, said ridges being positioned towards said lower ends of said leg portions, said ridges being for preventing said lower ends of the leg portions from sliding up a leg of a wearer;

said torso portion having a crotch region extending between said front and back of said torso portion, said crotch region being positioned between said leg portions, said crotch region having a cotton layer;

wherein said cotton layer of said crotch region is generally diamond shaped;

said cotton layer of said crotch region having a pair of points, one of said points being positioned towards said front of said torso portion, another of said points being positioned towards said back of said torso portion, wherein a length of said cotton layer between said points is less than about six inches;

wherein said length of said cotton layer of said crotch region between said points is about four inches;

wherein a length of each of said leg portions is defined between said root portion and said lower ends of each of said leg portions, said length of each of said leg portions being greater than about two inches;

wherein said length of each of said leg portions is between about three and seven inches;

wherein the elasticity of said leg bands around said lower openings of said leg portions is less than about one half the elasticity of said waist band around said periphery of said upper waist opening of said torso portion; and each of said leg bands of the leg portions having a primary edge and a secondary edge, wherein a width of each of said leg bands is defined between said primary and secondary edges of each of said leg bands, said width of each of said leg bands being between about one fifth and one tenth said length of each of said leg portions.

15. An undergarment for eliminating panty lines while wearing shorts or skirts, said undergarment comprising:

a torso portion having a front, a back, a top, a bottom, and an upper waist opening;

said upper waist opening of said torso portion having a periphery;

a resiliently elastic waist band extending around said periphery of said upper waist opening;

a pair of leg portions extending from said bottom of said torso portion, each of said leg portions having a root portion and a lower end, said root portions of said leg portions being coupled to said bottom of said torso portion;

said lower end of each of said leg portions having a lower opening and a leg band; and wherein each of said leg bands of the leg portions has a primary edge and a secondary edge, wherein a width of each of said leg bands is defined between said primary edge of said leg band and said secondary edge of said leg band, said width of each of said leg bands being between about one fifth and one tenth said length of each of said leg portions.

16. The undergarment of claim 15, wherein said torso portion has a crotch region extending between said front and back of said torso portion, said crotch region being positioned between said leg portions, said crotch region having a cotton layer.

17. The undergarment of claim 16, wherein said cotton layer of said crotch region is generally diamond shaped.

18. The undergarment of claim 17, wherein said cotton layer of said crotch region has a pair of points, one of said points being positioned towards said front of said torso portion, another of said points being positioned towards said back of said torso portion, wherein a length of said cotton layer between said points is less than about six inches.

19. The undergarment of claim 16, wherein said cotton layer of said crotch region is generally rectangular shaped, said cotton layer having a pair of ends, one of the ends being positioned towards the front of the torso portion, another of the ends being positioned towards the back of the torso portion, wherein a length of said cotton layer between said ends is less than about eight inches.

* * * * *